United States Patent [19]

Birman et al.

[11] Patent Number: 4,741,786

[45] Date of Patent: May 3, 1988

[54] COLD DRAWN FREE-MACHINING STEEL BAR INCLUDING BISMUTH

[75] Inventors: Stephen P. Birman, Mayfield Heights; Richard B. Smith, Elyria; Richard L. Thompson, Amherst, all of Ohio

[73] Assignee: Stanadyne, Inc., Windsor, Conn.

[21] Appl. No.: 872,557

[22] Filed: Jun. 10, 1986

[51] Int. Cl.[4] ..... C22C 38/60

[52] U.S. Cl. ..... 148/320; 420/84; 420/87

[58] Field of Search ..... 148/320, 332, 333, 336, 148/12 C, 12.1, 12 B, 12 F, 909; 420/84, 87; 72/274

[56] References Cited

U.S. PATENT DOCUMENTS 4,255,187 3/1981 Bhattacharya et al. ..... 420/84
4,255,188 3/1981 Riekels ..... 420/84
4,333,776 6/1982 Bhattacharya et al. ..... 148/320

FOREIGN PATENT DOCUMENTS 2937908 4/1980 Fed. Rep. of Germany ..... 420/84

*Primary Examiner*—Deborah Yee
*Attorney, Agent, or Firm*—Kinzer, Plyer, Dorn, McEachran & Jambor

[57] ABSTRACT

A cold drawn free-machining steel bar having a composition consisting essentially of, in weight percent, C up to 0.15; Mn 0.7 to 1.3; P 0.03 to 0.09; S 0.30 to 0.50; Bi 0.05 to 0.25; the sum of Ni, Cr, Mo and Cu up to 0.15 and the balance iron. The ratio % Mn / %S is from 1.7 to 3.0 and the $\%Mn - 1.62 \times \%S$ is from 0.05 to 0.40. The ratio $\%Bi / (\%Ni + \%Cu)$ is at least 2.0. The yield strength of the steel bar is further determined by the draft in cold drawing the bar from the hot rolled state and the cross section of the bar prior to draft.

15 Claims, No Drawings

COLD DRAWN FREE-MACHINING STEEL BAR INCLUDING BISMUTH

SUMMARY OF THE INVENTION

The present invention relates to cold drawn free-machining steel bars with particular emphasis on improving the machinability characteristics through relating the optimum chemical composition of the steel with the percent reduction in cold working to obtain predetermined yield strengths.

A primary purpose of the invention is a cold drawn free-machining resulfurized and rephosphorized steel bar which has a reduced manganese/sulfur ratio, increased sulfur content and predetermined amounts of bismuth.

Another purpose is a cold drawn free-machining steel bar including bismuth to increase machinability.

Another purpose is a bismuth-bearing cold drawn free-machining steel bar which may be formed of carbon steel, manganese steel, and resulfurized and rephosphorized steel.

Another purpose is a cold drawn free-machining steel bar having increased machinability characteristics so as to reduce machining costs and increase quality of machined parts.

Another purpose is a cold drawn free-machining steel bar as described which optimizes the ratios between bismuth and carbon, sulfur and manganese, and bismuth, nickel and copper.

Another purpose is a cold drawn steel bar as described which optimizes the chemical composition of the bar, the size of the hot rolled bar before cold drawing, and the percent of area reduction in cold drawing to provide bars for specific machining applications and targeted yield strengths.

Other purposes will appear in the ensuing specification and claims

DETAILED DESCRIPTION OF THE INVENTION

The most widely known and used additives for increasing the machinability of cold drawn steel bars are lead, bismuth and tellurium, in combination with a large volume of manganese sulfide inclusions. The inclusions act as stress raisers in the region of primary shear, while lead and bismuth lower the shear strength at the elevated temperatures generated during a machining operation and appear on the smooth surface of the chip, acting as a lubricant at the interface between chip and tool.

The present invention uses bismuth as a free-machining additive and correlates the amount of bismuth with the amounts of manganese and sulfur, along with optimizing the amounts of these elements in accordance with the side of the hot rolled bar prior to cold drawing and the percent reduction during cold drawing, all directed toward obtaining a target yield strength for particular machining operation. The present invention further provides improved machinability in a bismuth-bearing steel bar by means of an increased sulfur content and a decreased manganese/sulfur ratio.

It is widely recognized that bismuth-bearing steels show improved machinability with or without the addition of lead. Bismuth improves machinability because it has the lowest melting point among free-machining additives and the strongest ability to weaken interfacial boundaries. Further, the relatively small difference in specific gravity between bismuth and iron prevents macro segregation of bismuth during solidification. Bismuth exists in the form of particles attached not only to manganese sulfide inclusions, but also to ferrite-pearlite interfaces and grain boundaries. Varying amounts of bismuth, lead and tellurium (U.S. Pat. Nos. 4,247,326; 4,255,187; 4,255,188; and U.S. Pat. No. 4,333,776) have been included in free-machining resulfurized and rephosphorized steels. However, the addition of one or more of these elements alone is not sufficient to maximize the machinability characteristics of a steel bar. What is required is to optimize the chemistry of the bar with the size of the hot rolled material and the percent of area reduction in cold drawing, so as to provide steel bars of predetermined yield strengths.

In its broadest form, the present invention provides a cold drawn free-machining steel bar having a composition consisting essentially of, in weight percent:

C up to 0.15
Mn 0.7 to 1.3
P 0.03 to 0.09
S 0.30 to 0.50
Bi 0.05 to 0.25
The sum of Ni, Cr, Mo and Cu up to 0.15;
balance iron;
the ratio %Mn / %S is from 1.7 to 3.0;
the %Mn - 1.62 X %S is from 0.05 to 0.40; and
the ratio %Bi / (%Ni + %Cu) is at least 2.0.

This particular chemical composition provides for a bismuth-bearing steel bar with a sulfur content increased over bars of this general type, which have heretofor been available, and also with a reduced manganese/sulfur ratio. The relationship between manganese and sulfur is important. If %Mn - 1.62 X %S is greater than 0.4, the amount of manganese which has not combined with sulfur is excessive and adversely affects machinability of a bismuth-bearing steel bar.

The term "steel bar" as used herein has application to a cut length bar which may be derived from hot rolled coil or from hot rolled bars.

The chemical composition of the bar can be more closely defined when considering the type of hot rolled material and the percent of area reduction in cold drawing and the desired yield strength. In using hot rolled round and hexagonal coil with a chemical composition as described herein, the reduced amount of manganese and carbon prevent extensive strengthening in cold working. High strength and excessive brittleness which might reduce tool life and cause chip packing in drilling are substantially reduced. As a specific example of the use of hot rolled round and hexagonal coil, a cold drawn steel bar has the composition consisting essentially of, in weight percent:

C 0.07 to 0.09
Mn 0.7 to 0.9
S 0.3 to 0.4
P 0.03 to 0.07
Bi 0.05 to 0.15
The sum of Ni, Cr, Mo and Cu up to 0.15;
balance iron;
the ratio %Mn / %S being 1.7 to 2.8;
the %Mn - 1.62 X %S being from 0.05 to 0.30; and
the ratio %B / (%Ni + %Cu) is at least 2.0.

Such a bar may have a reduction in area in cold drawing from 10% to 30%. More specifically, a reduction in area in cold drawing from 10% to 20% provides a yield strength of on the order of about 60 ksi, whereas a bar having an area reduction in cold drawing of 20% to 30% provides a yield strength of on the order of about 70 ksi. A bar with a yield strength of 60 ksi provides for excellent tool life in high speed machining, whereas a bar with a 70 ksi yield strength provides superior surface finish in high speed machining.

The manganese, sulfur and bismuth content increases with an increase in size of the cold drawn bar. Normally, hot rolled coil has a diameter of on the order of about one inch. An increase in the size of the hot rolled product necessitates an increase in manganese, sulfur and bismuth. Thus, a hot rolled bar having a diameter up to two inches has a composition consisting essentially of, in weight percent:

C 0.09 to 0.11
Mn 0.9 to 1.1
S 0.36 to 0.46
P 0.04 to 0.08
Bi 0.05 to 0.15
The sum of Ni, Cr, Mo and Cu up to 0.15;
balance iron;
the ratio %Mn / %S being 1.9 to 2.8;
the %Mn - 1.62 X %S being 0.15 to 0.40; and
the ratio %Bi / (%Ni +%Cu) is at least 2.0.

With a reduction in area during cold drawing of from 6% to 10%, such a bar will provide yield strengths of 60 to 70 ksi. More specifically, when the reduction in area in cold drawing is from 6% to 8%, there is a yield strength of on the order of about 60 ksi, which bar provides excellent tool life in high speed machining. A reduction in area in cold drawing of from 8% to 10% provides a yield strength of on the order of about 70 ksi and superior surface finish for multiple operating machines.

For hot rolled bars having a diameter of over two inches, the amounts of manganese, sulfur and bismuth are increased over that specified for a hot rolled bar having a size under two inches. Thus, a hot rolled bar having a diameter over two inches has a composition consisting essentially of, in weight percent:

C 0.06 to 0.13
Mn 0.8 to 1.3
P 0.06 to 0.09
S 0.32 to 0.50
Bi 0.15 to 0.25
Sum of Ni, Cr, Mo and Cu up to 0.15;
balance iron;
the ratio %Mn / %S is from 2.0 to 3.0;
the %Mn - 1.62 X %S is 0.2 to 0.4; and
the ratio %Bi / (%Ni +%Cu) is at least 2.0.

A bar having this composition and with a reduction in area during cold drawing of from 3% to 6% will provide a yield strength between 60 and 70 ksi. As a further refinement of the invention, hot rolled bars having a diameter at least two inches will utilize a more specific chemical composition depending upon whether the bar is round, square or hexagon. Hot rolled hexagon bars have a reduced amount of carbon, manganese and phosphorus to improve tool life in rough forming. A hexagon bar should have the following composition consisting essentially of, in weight percent:

C 0.06 to 0.08
Mn 0.8 to 1.0
P 0.06 to 0.09
S 0.32 to 0.40
Bi 0.15 to 0.25
Sum of Ni, Cr, Mo and Cu up to 0.15;
balance iron;
the ratio %Mn / %S is from 2.0 to 2.8;
the %Mn - 1.62 X %S is 0.2 to 0.4; and
the ratio %Bi / (%Ni +%Cu) is at least 2.0.

A round or square bar hot rolled from the same over two inch stock should have the following composition consisting essentially of, in weight percent:

C 0.10 to 0.13
Mn 1.0 to 1.3
P 0.06 to 0.09
S 0.40 to 0.50
Bi 0.15 to 0.25
Sum of Ni, Cr, Mo and Cu up to 0.15;
balance iron;
the ratio %Mn / %S is from 2.2 to 3.0;
the %Mn - 1.62 X %S is 0.2 to 0.4; and
the ratio %Bi / (%Ni +%Cu) is at least 2.0.

The ratio of bismuth to the sum of nickel and copper is important and should not be lower than 2.0. This utilizes the low melting point of bismuth for increased machinability, as ratios lower than 2.0 will diminish the effect of bismuth. There is no particular restriction on the amounts of chromium and molybdenum, providing the sum of these two elements plus that of nickel and copper does not exceed the 0.15% specified.

Other free-machining additives are also useful in appropriate amounts. Lead in the amount of 0.05% to 0.15% by weight is useful as is zirconium in the amount of 0.005% to 0.05%; tellurium in an amount 0.002% to 0.1%; and nitrogen in an amount 0.006% to 0.012%.

The addition of bismuth in the amount specified permits an increase in the speed of a cutting tool during a machining operation, as does an increase in the amount of sulfur as specified. The inclusion of both bismuth and an increased amount of sulfur provides for a multiplicative increase in the cutting speed. The addition of these two elements does not have a substantial effect on the rate of feed or the depth of cut, as the increase in machinability is primarily related to cutting speed.

By optimizing the yield strength and strain hardening as specified herein, both by controlled chemistry and controlling the percent of area reduction in cold drawing it is possible to increase both the feed and the depth of cut in machining operations. Further, by adding bismuth and sulfur as specified, along with optimizing strength and strain hardening, the effect on feed and depth of cut is again multiplicative. By adding lead along with bismuth, there is a further increase in the permitted cutting speed, with this effect again being multiplicative when considering the increased amount of sulfur and the optimized strength and strain hardening as described.

Whereas the preferred form of the invention has been shown and described herein, it should be realized that there may be many modifications, alterations and substitutions thereto.

We claim:

1. A cold drawn free-machining steel bar having a composition consisting essentially of, in weight percent:

C up to 0.15
Mn 0.7 to 1.3
P 0.03 to 0.09
S 0.30 to 0.50
Bi 0.05 to 0.25
The sum of Ni, Cr, Mo and Cu up to 0.15;
balance iron;
the ratio %Mn / %S is from 1.7 to 2.8
the %Mn - 1.62 X %S is from 0.05 to 0.40; and
the ratio %Bi / (%Ni +%Cu) is at least 2.0.

2. The cold drawn steel bar of claim 1 further including, in weight percent, Pb from 0.05 to 0.15.

3. The cold drawn steel bar of claim 1 further including, in weight percent, Zr from 0.005 to 0.05.

4. The cold drawn steel bar of claim 1 further including, in weight percent, Te from 0.002 to 0.1.

5. The cold drawn steel bar of claim 1 further including, in weight percent, N from 0.006 to 0.012.

6. A cold drawn free-machining steel bar formed by cold drawing hot rolled coil, said bar having a composition consisting essentially of, in weight percent:
C 0.07 to 0.09
Mn 0.7 to 0.9
S 0.30 to 0.40
P 0.03 to 0.07
Bi 0.05 to 0.15
The sum of Ni, Cr, Mo and Cu up to 0.15;
balance iron;
the ratio %Mn / %S is from 1.7 to 2.8;
the %Mn - (1.62 X %S) is from 0.05 to 0.30;
the ratio %Bi / (%Ni +%Cu) is at least 2.0; and
the reduction in area in cold drawing the bar from hot rolled coil is from 10% to 30%.

7. The cold drawn steel bar of claim 6 further characterized in that the reduction in area from cold drawing the bar is from 10% to 20%, providing a yield strength of on the order of about 60 ksi.

8. The cold drawn steel bar of claim 6 further characterized in that the reduction in area from cold drawing the bar is from 20% to 30%, providing a yield strength of on the order of about 70 ksi.

9. The cold drawn steel bar of claim 6 further characterized in that the hot rolled coil has a hexagonal shape, the cold drawn bar having a hexagonal shape and the reduction in area from cold drawing the bar is from 10% to 10. A cold drawn free-machining steel bar formed by cold drawing a hot rolled bar up to two inches in diameter, said bar having a composition consisting essentially of, in weight percent:
C 0.09 to 0.11
Mn 0.9 to 1.1
S 0.36 to 0.46
P 0.04 to 0.08
Bi 0.05 to 0.15
The sum of Ni, Cr, Mo and Cu up to 0.15;
balance iron;
the ratio %Mn / %S being 1.9 to 2.8;
the %Mn - (1.62 X %S) being 0.15 to 0.40;
the ratio %Bi / (%Ni +%Cu) is at least 2.0; and
the reduction of area in cold drawing the bar is from 6% to 10%.

11. The cold drawn steel bar of claim 10 further characterized in that the reduction in area from cold drawing the bar is from 6% to 8%, providing a yield strength of on the order of about 60 ksi.

12. The cold drawn steel bar of claim 10 further characterized in that the reduction in area from cold drawing the bar is from 8% to 10%, providing a yield strength of on the order of about 70 ksi.

13. A cold drawn free-machining steel bar formed by cold drawing a hot rolled bar having a diameter at least two inches, the bar having a composition consisting essentially of, in weight percent:
C b 0.06 to 0.13
Mn 0.8 to 1.3
P 0.06 to 0.09
S 0.32 to 0.50
Bi 0.15 to 0.25
The sum of Ni, Cr, Mo and Cu up to 0.15;
balance iron;
the ratio %Mn / %S being 2.0 to 2.8
the %Mn -.1 62 X %S being 0.2 to 0.4;
the ratio %Bi / (%Ni +%Cu) is at least 2.0; and
the reduction of area in cold drawing the bar is from 3% to 6%.

14. The cold drawn steel bar of claim 13 further characterized in that the bar has a round or square cross section and has a composition essentially of, in weight
C 0.10 to 0.13
Mn 1.0 to 1.3
P 0.06 to 0.09
S 0.40 to 0.50
Bi 0.15 to 0.25.

15. The cold drawn steel bar of claim 13 further characterized in that the bar has a hexagon shape and has a composition consisting essentially of, in weight percent:
C 0.06 to 0.08
Mn 0.8 to 1.0
P 0.06 to 0.09
S 0.32 to 0.40
Bi 0.15 to 0.25; and
the reduction of area in cold drawing the bar is from 3% to 5%.

* * * * *